US006259356B1

(12) United States Patent
Tamaoki et al.

(10) Patent No.: US 6,259,356 B1
(45) **Date of Patent: *Jul. 10, 2001**

(54) DRUG PRESERVER

(75) Inventors: Yuichi Tamaoki, Ooizumi-machi; Hiroki Busujima, Ota; Shigeyuki Nakamura, Oizumi-machi, all of (JP)

(73) Assignee: Sanyo Electric Co., Ltd., Gunma-Ken (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/093,304

(22) Filed: Jun. 9, 1998

(30) Foreign Application Priority Data

Jun. 11, 1997 (JP) ..... 9-153408
Jan. 14, 1998 (JP) ..... 10-017676

(51) Int. Cl.[7] ..... G08B 1/00

(52) U.S. Cl. ..... 340/309.15; 340/568.1; 221/2; 221/3; 221/15; 368/10; 702/177; 702/187

(58) Field of Search ..... 340/309.15, 870.09, 340/568.1, 569, 573.1, 479.01; 364/479.01; 221/15, 2, 9, 3; 702/177, 187; 368/10, 105, 109, 110, 111, 112, 113

(56) References Cited

U.S. PATENT DOCUMENTS

| | | | | |
|---|---|---|---|---|
| 4,275,384 | * | 6/1981 | Hicks et al. | 340/309.4 |
| 4,768,177 | * | 8/1988 | Kehr et al. | 368/10 |
| 4,911,327 | * | 3/1990 | Shepherd et al. | 221/3 |
| 4,967,928 | * | 11/1990 | Carter | 221/2 |
| 5,016,172 | * | 5/1991 | Dessertine | 364/413.02 |
| 5,159,581 | * | 10/1992 | Agans | 368/10 |
| 5,289,157 | * | 2/1994 | Rudick et al. | 340/309.15 |
| 5,408,443 | * | 4/1995 | Weinberger | 368/10 |
| 5,454,427 | * | 10/1995 | Westbrooks et al. | 164/12 |
| 5,564,593 | * | 10/1996 | East, Sr. | 221/3 |
| 5,572,873 | * | 11/1996 | Lavignet et al. | 62/3.62 |
| 5,710,551 | * | 1/1998 | Ridgeway | 340/870.09 |

* cited by examiner

*Primary Examiner*—Edward Lefkowitz
*Assistant Examiner*—Davetta W. Goins
(74) *Attorney, Agent, or Firm*—Armswtrong, Westerman, Hattori, McLeland & Naughton, LLP

(57) ABSTRACT

A preserver for preserving drugs, comprising a door detector for detecting opening/closing the door of the preserver; a controller for determining whether the door was opened or not during a predetermined period of time based on the signal supplied by the door detector. When it is determined that the door was not opened at all in the period, the controller generates an alarm signal indicative of the determination to an administrator of the preserver. Upon receipt of the alarm signal, the administrator informs a medical facility of the situation, so that a further organized administration of the medical treatment may be provided.

7 Claims, 5 Drawing Sheets

DRUG PRESERVER

FIELD OF THE INVENTION

The invention relates to a preservation system (herein after referred to as a drug preserver) for appropriately administrating preservation and use of drugs by a patient and for watching development of an abnormal condition in the patient's health.

BACKGROUND OF THE INVENTION

As a result of promotion of medical supports or services for home treatment (hereinafter referred to as medical home services), the number of patients who may receive such home medical services is rapidly increasing. In most cases where these patients are placed under home medical services, a large part of the home medical service is left in the hands of helpers including a family member and a nursing staff who visit the patients at home periodically, so that the administration of other medical supplies (hereinafter referred to as medicines) is also left in the hands of these helpers. In such cases, therefore, medicines are not prepared daily by a pharmacist and administered by a nursing staff as in a hospital.

Because medicines can be degraded in quality by such environmental conditions as heat and moisture, patients who are recuperating at home often store medicines in the refrigerators. However, proper preservation temperature of medicines normally range from 2 to 8° C., so that the temperatures of the refrigerators are not necessarily appropriate for the medicines.

To meet demands of such home recuperating patients, special types of drug preservers have been distributed on the market, some of which are provided with a detection system for detecting improper preservation conditions and gives a necessary warning.

It should be noted that a patient is often supplied with several kinds of medicines which must be taken regularly in accordance with the prescription, which is difficult for many of the home recuperating patients, under existing home medical service systems because of lack of helpers.

In view of the fact that the number of aged lonely bedridden patients who need home medical services is increasing, this entails a serious problem, in particular when they forget taking the medicines or forget if taken the medicines have been as prescribed. Should the administration of home medical services be neglected, the patients may become worse and face retardation of convalescence.

Thus, it is becoming an increasingly important problem to administrate medicines for the home patient.

SUMMARY OF THE INVENTION

It is, therefore, an object of the invention to provide a drug preserver adapted to administrate medicines, to and monitor the conditions of, the patients.

To this end, according to one aspect of the invention, there is provided a drug preserver, comprising:

a door sensor, mounted on the inside of a door of the drug preserver, for generating a signal indicative of opening the door when the door is opened; and a control unit for determining if the door was opened in a predetermined period of time based on the signal received from the door sensor; and for generating an alarm when the door was not opened in the predetermined period. For example, if the control unit has received no signal from the door sensor for a day, indicating that the door was not opened that day, the controller determines that the medicines have not been properly taken by the patient and generates an alarm signal indicative of the determination.

With this drug preserver, it is possible to determine whether or not the patient has used the drugs properly. Improper dosage of medicines by the patient and a sudden change in the condition of the patient, for example, would be easily found.

The preserver may be provided with an emergency information system which may generate emergency information indicative of an emergency situation when the patient operates an emergency switch of the system in case of an emergency.

With this system, the preserver may administrate not only the patient's dosage of the medicines but also monitor the patient's condition, thereby facilitating emergency medical treatment to the patient.

The drug preserver may be provided with an environmental condition sensor for detecting at least either the temperature or the humidity inside the preserver so that the temperature and/or the humidity may be controlled within a predetermined range based on a signal received from the sensor, thereby enabling the preservation of the medicines in good condition.

The control unit of the preserver may be adapted to generate an alarm signal when the temperature and/or humidity exceeds the predetermined range(s), so that the patient is protected from taking the medicines that might have deteriorated under improper preservation conditions.

The various alarm signals mentioned above may be transmitted to an administrator who is in charge of the drugs and the medical treatments to the patient via a wired or wireless communication system. The remote administrator will be then informed promptly of the emergency condition of the patient, so that necessary help and care can be promptly supplied to the patient.

In another aspect of the invention, the drug preserver is adapted to be controlled to lock and unlock the door by a remote data terminal inputting the control information and transferring it via a wired or wireless communication system, as well as by a data terminal on the site.

With this arrangement of the preserver, the patient is restricted not to open/dose the door of the preserver by him/herself, so that the drugs may be easily administrated by the administrator.

The preserver may be provided therein with a multiplicity of preservation rooms having lockable drawers or small doors, so that the patient is only limited to take the medicines as prescribed.

The apparatus may be provided with a detector for detecting whether the door of a small preservation room were opened in a predetermined period after the small preservation rooms was unlocked, and for informing the administrator of the preserver of the use of the drug in the small preservation room. This will facilitate the administrator at a remote site in controlling and acknowledging the use of the medicines by the patient.

Each of the small preservation rooms may be provided with a sheet or panel mounted on the front end thereof for keeping information regarding the contents or the items stored in the small preservation room, and with a lamp mounted on the backside of the sheet or panel. The lamp is in cooperative association with the lock system of the preserver, so that it is turned on when the small preservation room is unlocked.

In this arrangement, the sheet and the lamp will help the patient to find out the location of the small preservation room and confirm the content of the medicines therein.

DETAILED DESCRIPTION OF THE PREFERRED EMBODIMENT

Figure 1:
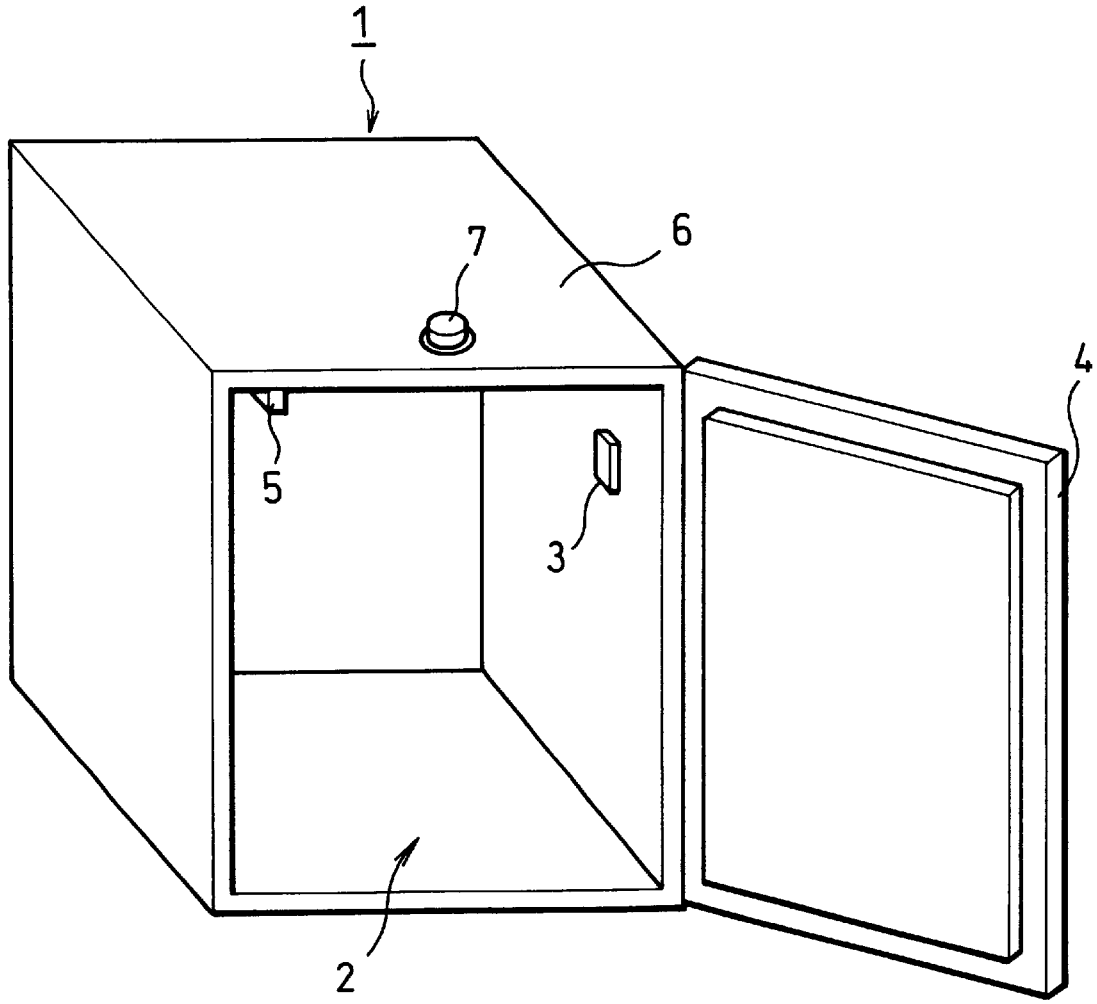
FIG. 1 is a perspective view of a drug preserver according to the invention.

Referring now to FIG. 1, there is shown a drug preserver according to the invention indicated generally by reference numeral 1. The drug preserver 1 is provided on the back thereof with an environmental condition regulator (not shown) for controlling the temperature and the humidity in the preservation room 2 of the preserver 1, and a control unit for not only controlling the operation of the preserver but also generating various kinds of alarms, as mentioned below, and exchanging information with an external or remote administrator via a wired or wireless communication system. Provided inside the preservation room 2 is a sensor 3 for sensing environmental conditions such as the temperature and the humidity in the preserver. Signals generated by the sensor are fed to the control unit.

Although the invention is described below for a case where a drug preserver is controlled by the environmental condition regulator based on both the temperature and humidity in the preservation room 2 for a better control of the preserver, it should be understood that some preservers may be controlled based only on either the temperature or the humidity. Thus, the environmental condition regulator for controlling both the temperature and the humidity in the preservation room 2 may be optionally provided as needed. If the regulation of the temperature or the humidity is not needed, the environmental condition regulator and the sensor 3 are not needed.

Mounted on the inside of the door 4 is a door sensor 5 which is turned ON/OFF by opening/closing the door 4, generating a signal indicative of the opening/closing of the door 4. On the top 6 of the drug preserver 1 is an emergency switch 7. It would be apparent that the position of the emergency switch 7 is not limited to the top, but it could be positioned elsewhere, for example on the door 4 or on the side wall of the drug preserver 1.

The temperature and the humidity in the preservation room 2 may be regulated by means of either one of the two typical regulation systems: a compressor for compressing/expanding a refrigerant as in a case of a small refrigerator; and an electronic cooling device (e.g. Peltier element). Since such drug preserver 1 is normally arranged in the patient's living room, the ambient temperature is a room temperature. Then the temperature and the humidity in the drug preserver 1 may be regulated by simply turning ON/OFF the environmental condition regulator, regardless of the type of the regulator. In addition, a known type of humidiator/dehumidiator may be provided if more precise regulation of the humidity is required.

Such drug preserver 1 may be installed in a house of a home recuperating patient who lives by him/herself. The preserver 1 may then be utilized for better administration of the medical treatment to the patient in that it may control the medicines and monitor the conditions of the patient's health.

The necessary medicines for the patient are delivered by a visiting nursing staff and stored in the drug preserver 1. The nursing staff also inputs a schedule for the patient in a data input device of the drug preserver 1 so that the patient will use the medicines as prescribed (for example three times at 7, 11, and 17 o'clock), and other data such as the preservation temperature (for example 5° C.), and the preservation humidity (for example 50%) for the medicines.

As described above, the control unit provided in the drug preserver 1 has a communication system for establishing communication between the drug preserver 1 and external facilities. For example, the communication system may include a portable input/output unit having a transceiver (like a portable telephone unit), a memory, a liquid crystal display, and input keys, so that the staff can input necessary monitoring information in the control unit through the input/output unit. The drug preserver 1 may be alternatively provided on the upper section thereof and connected with a control panel having input keys for inputting the monitoring information. The portable input/output unit enables the visiting staff to store such information as the condition of the patient's health and patient's demands, and brings it back to the patient's doctor. Thus, the portable unit will help the medical service system to establish an organized administration of the home medical services to the patient, including monitoring of the condition of the patient's health.

Based on the information for monitoring the patient, input through the input/output unit or the control panel, the control unit may monitor the signal received from the sensor 3, and control the temperature and the humidity in the preservation room 2 to be within predetermined ranges (with the temperature in the range of 5±1° C., and the humidity in the range of 45–85%, for example).

The control unit is provided with a timer which activates the door sensor 5 monitoring the door 4 when it becomes a preset time (for example 7 o'clock for a dose) as set by the visiting staff. The monitoring of the door 4 is continued for three hours, for example. Therefore, if no signal is received from the door switch 5 at all from 7 to 10 o'clock, the control unit makes a determination that the door 4 was not opened by the patient and s/he has not taken the medicines in the morning, and the control unit judges that some abnormal conditions have developed with the patient and it generates an alarm.

The alarm signal is provided, via a telephone line or any other wired or wireless communication system, to a relevant administrator 8 (FIG. 2), such as a security company, a pharmaceutical office, a nursing station, and a doctor as well as to a neighbor, for example, who is asked to take care of the patient.

In an emergency case where, for example, the patient has fallen into an unexpected serious condition, the patient may operate the switch 7 so that the control unit will inform the administrator 8 of the situation.

It is, of course, possible not to generate the alarm even when the patient has forgotten taking scheduled medicine, if it would not be a serious problem to the patient and would not develop any harmful condition in the patient. In this case, the fact that the patient has not taken the medicine will be recorded in the control unit as diagnostic information available to the visiting medical service staff who visits the patient next time.

Upon receipt of the alarm, the administrator 8 may telephone or visit the patient to determine his/her situation, and inform the hospital 9. Thus, the hospital 9 may take necessary actions based on the information.

If the environmental condition regulator becomes defective, failing to preserve the medicines in normal conditions, the control unit may generate an alarm, or store information, indicative of the malfunction.

Figure 3:
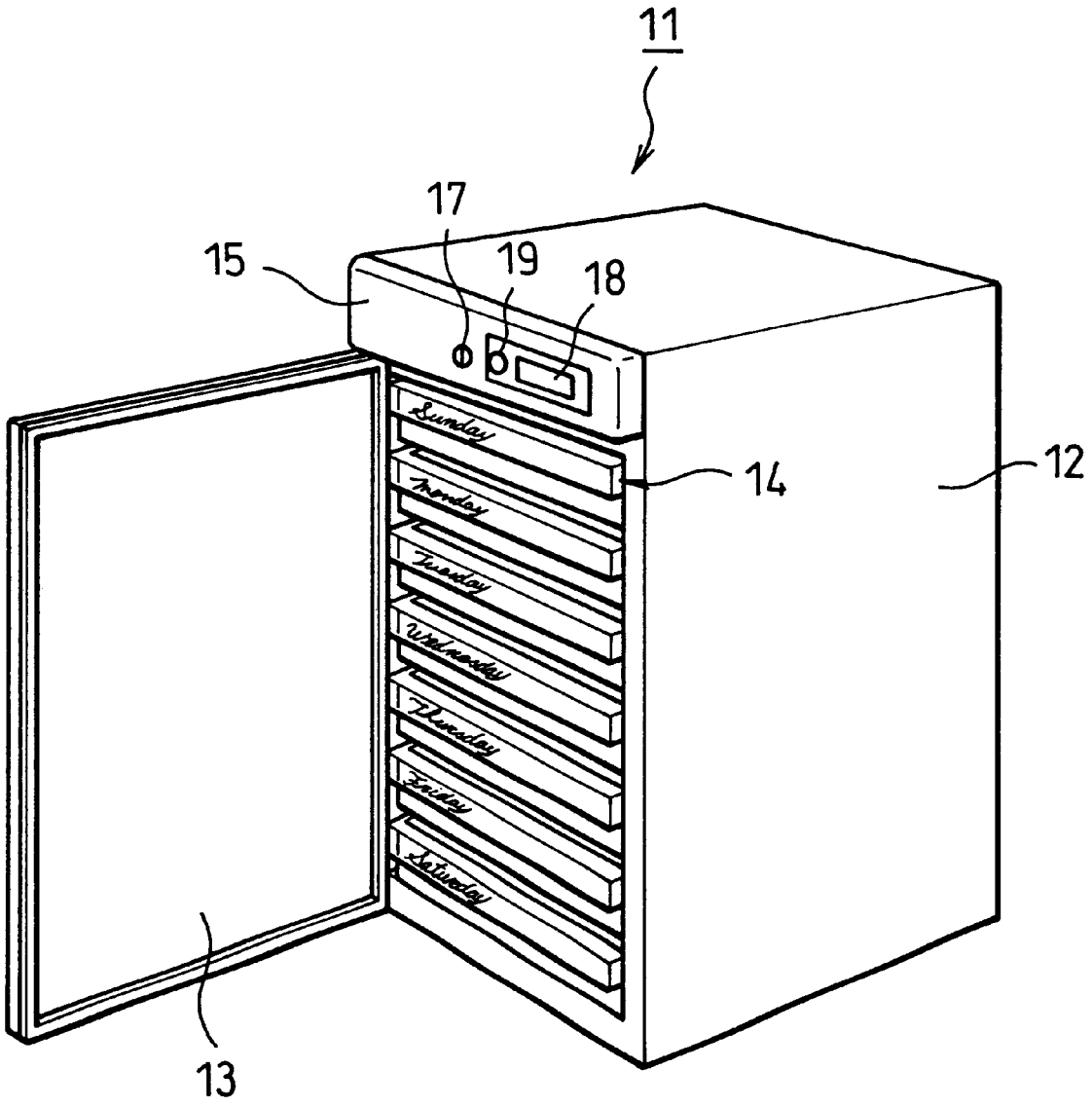
FIG. 3 is a perspective view of another drug preserver according to the invention.
Figure 4:
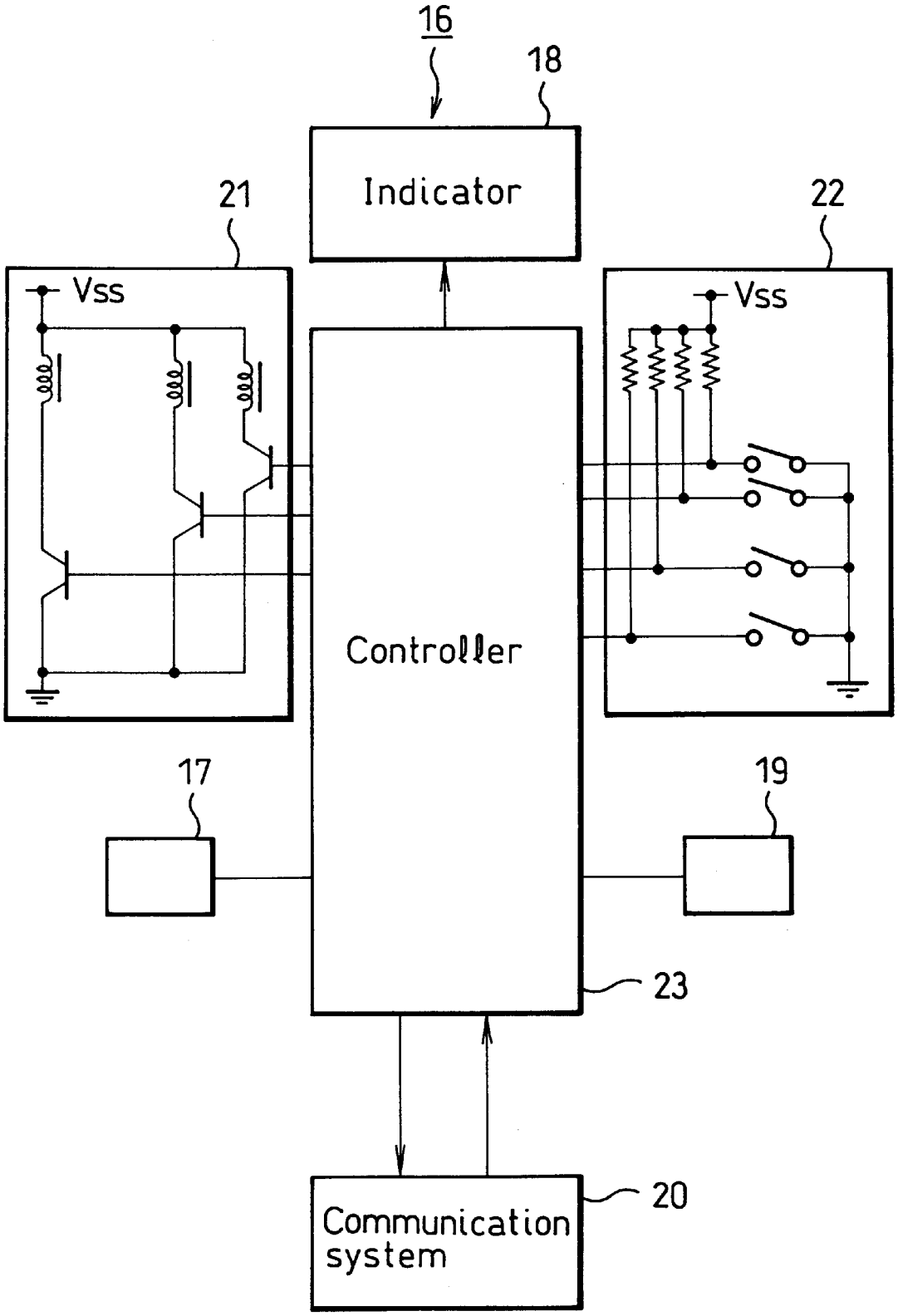
FIG. 4 is a block diagram of a control unit provided in the drug preserver shown in FIG. 3.

Referring now to FIG. 3, there is shown another drug preserver 11 according to the invention. This drug preserver 11 comprises a housing 12 made of a thermally insulating material, a door 13, and a multiplicity of drawers 14 in the inner space of the drug preserver 11. The drug preserver 11 is also provided on the back thereof with an environmental condition regulator for controlling the temperature and the humidity in the preserver 11 using a refrigeration system which includes a compressor or an electronic cooling unit in the same manner as in the preceding example. Mounted on an upper section of the drug preserver 11 is a control unit 16 (FIG. 4). On the upper front end of the drug preserver 11 are a door lock system 17 for locking the door 13, an indicator 18 for indicating various administrative information, and an emergency switch 19.

Although the example shown herein below is described for a type of drug preservers 11 having a multiplicity of drawers 14, the invention is not limited to this type. For example, the drug preserver 11 may alternatively have a multiplicity of small partitioned preservation rooms having respective small doors.

FIG. 4 is a block diagram of the control unit 16. The control unit 16 includes the door lock system 17 for the door 13, the indicator 18 for indicating data such as the temperature in the drug preserver 11, the emergency switch 19, a communication system 20 for exchanging information with external facilities, a small-door lock system 21 having electromagnetic relays for opening/closing individual drawers 14, a detector 22 for sensing opening/closing of the drawers 14, and a controller 23 connected with the elements mentioned above for controlling the operation of the communication system 20 to communicate with the external facilities, the door lock system 17, the small-door lock system 21, and the indicator 18, based on the administrative information input through the communication system or directly input through a data input unit.

The door lock system 17 and the small-door lock system 21 are normally controlled by the controller 23. However, while the door lock system 17 is unlocked by a master key, the controller 23 is stopped. Under this condition, all the drawers 14 and the door 13 are also unlocked. When the door lock system 17 is locked by the master key, the controller 23 starts its operation, controlling the door lock system 17 and the small-door lock system 21.

There is provided on the front end of each drawer 14 a transparent or semi-transparent recording sheet or panel, behind which is a lamp (not shown). The lamp is electrically connected with the small-door lock system 21, so that it is turned on when the associated drawer 14 is unlocked by the small-door lock system 21, indicating the drawer that can be opened by hand and illuminating the recording sheet so that it can be read even in the dark and the content can be known.

As in the preceding example, the environmental condition regulator regulates the temperature and the humidity in the drug preserver 11 within predetermined ranges for adequate preservation of the medicines in the drug preserver 11. The temperature is indicated on the indicator 18.

Figure 2:
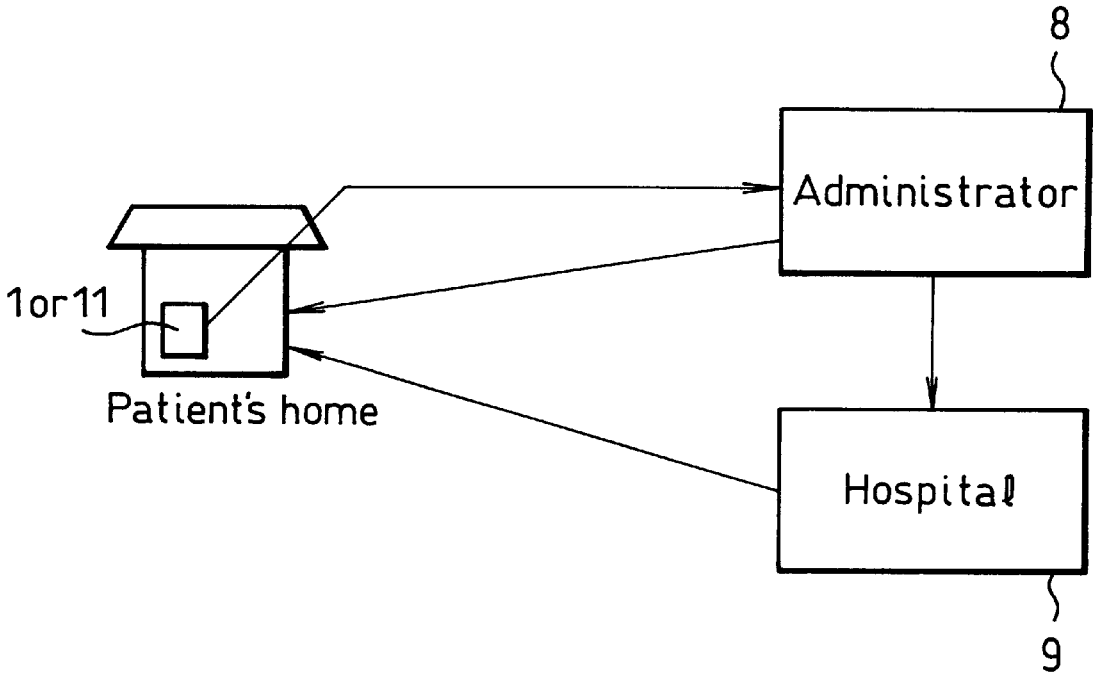
FIG. 2 is a schematic diagram useful in explaining a monitoring system that utilizes the drug preserver of the invention in administrating the medicines and the home medical services to a patient.

In this example, as in the preceding example, it is possible to regulate either or both of the temperature and/or the humidity. The regulator may be equipped as required. As shown in FIG. 2, the drug preserver 11 is connected with the administrator 8 by a wired communication system, such as telephone or a wireless communication system, to secure monitoring of the patient.

When the door lock system 17 is locked by the master key, bringing the controller 23 into operation, the door 13 and all the drawers 14 are locked. Medical equipment and medicines needed for the treatment of the patient are stored in the drug preserver 11 by the administrator 8 as follows. The administrator 8 inserts the master key in the door lock system 17 to unlock the door lock system 17 and stop the operation of the controller 23. This causes the door 13 and all the drawers 14 to be unlocked.

Under this condition, the administrator 8 may store necessary medical treatment supplies in the drawers and record on each recording sheet of the individual drawers 14 such data as kinds, dosage, and scheduled date and time to take the medicines. The administrator 8 may alternatively slip in a slit of the drawer a thin label carrying the data (so that when the drawer is lighted by the lamp, the patient can tell the drawer by the light and read the label).

The administrator 8 then closes the drawers 14, shuts the door 13, and locks the door lock system 17 by the master key, which activates the controller 23. The controller 23 then receives, through the communication system 20, conditional data (referred to as administrative information for the preserver) to open the door 13 and the drawers 14, from the terminal of the administrator 8. Of course the administrative information may be input directly to the controller 23.

Such administrative information includes, for example, date and time for the patient to take the medicines (e.g. 2nd drawer at 13 o'clock on Jan. 10, 1998), duration of monitoring the doors and the drawers opened/closed (e.g. 30 minutes), preservation temperature (e.g. 5° C.), and preservation humidity (e.g. 50%).

The length of the monitoring period is set for the following purposes. When the patient has become unable to move by him/herself, the drawer 14 will not be opened on schedule. To see if this is the case, opening/closing of the drawers 14 is checked by the detector 22 for a predetermined period of time subsequent to the unlocking of the drawers 14. Thus, if the drawers 14 were not opened during the period, the controller 23 may determine that the patient is in an immovable condition.

Figure 5:
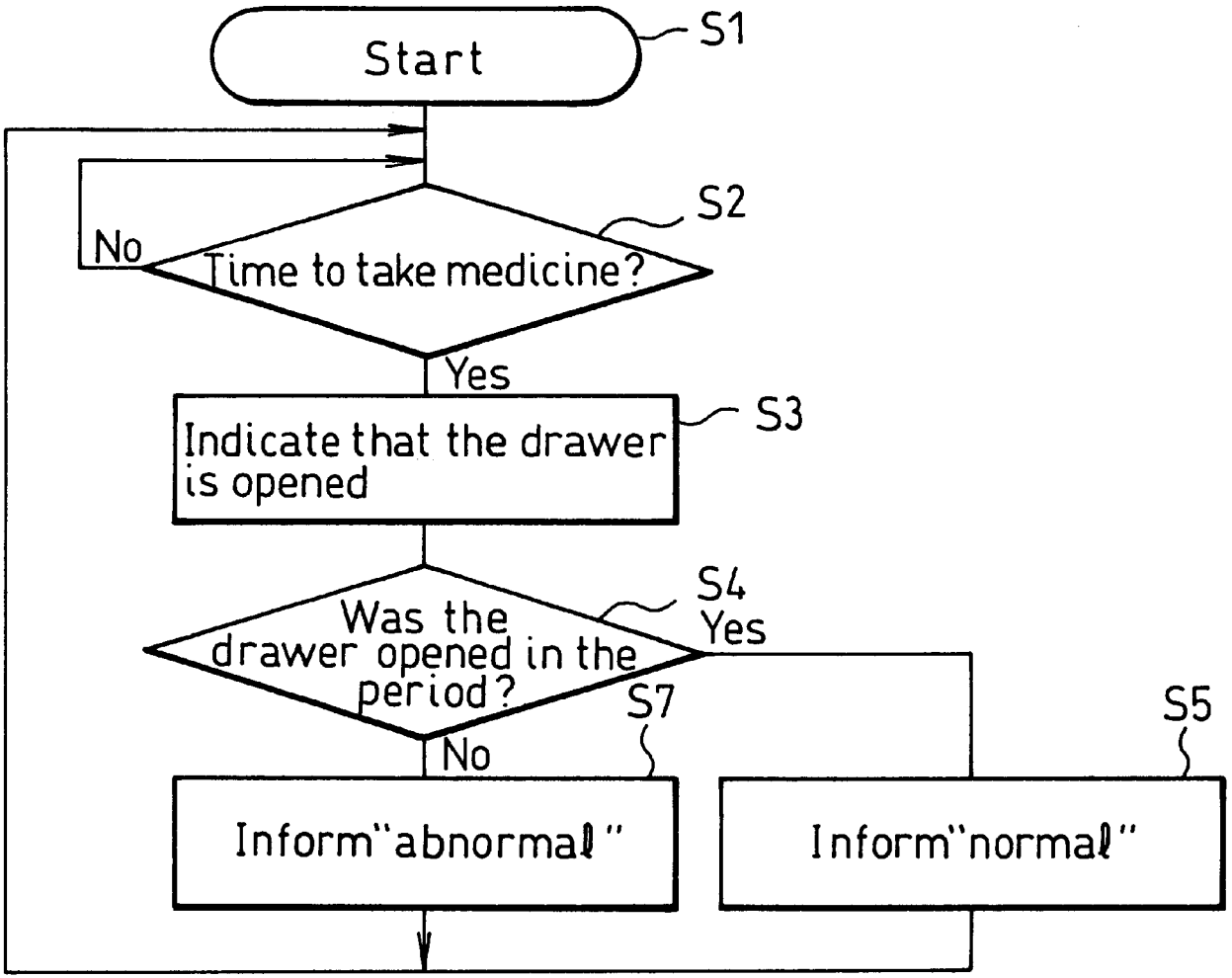
FIG. 5 is a flow-chart of an operation carried out by the control unit shown in FIG. 4.

As described above, upon completion of setting medical treatment supplies in the drug preserver 11, the environmental conditions are set for the preserver 11, and the corresponding preservation-monitoring operation begins (step S1 of FIG. 5). Accordingly, the temperature and the humidity in the drug preserver 11 are kept in the predetermined ranges (e.g. temperature within 5±1° C., with humidity in the range of 45–65%) by the environmental condition regulator.

When the time comes for the patient to take the medicines (step S2), a message like, "JUST TIME TO TAKE A MEDICINE," is indicated on the indicator 18, and a corresponding one of the drawers 14 is unlocked by the small-door lock system 21 (step S3). Then the lamp is turned on to illuminate the drawer, so that the patient can easily recognize it and read the record thereon even in the dark Since the drawers 14 are monitored by the detector 22, the controller 23 judges that the patient has normally taken the medicine when the drawer 14 is opened. The controller 23 then informs the administrator 8 of the patient's condition (e.g. "NORMAL") through the communication system 20 (steps S4 and S5).

On the other hand, if the patient did not open the drawer 14 in the monitoring period, the controller 23 judges that the patient is in some abnormal condition and informs the administrator 8 of the patient's condition (e.g. "ABNORMAL") (steps S4 and S7).

Upon receipt of the information indicative of an abnormal condition of the patient, the administrator 8 promptly informs a doctor in charge of the case in the hospital. At the same time, the administrator 8 visits the patient to confirm his/her condition, and reports to the doctor of the situation. The doctor will then take over the medical treatment to the patient.

In the example shown hereinabove, if the patient did not open the drawer 14 because of his or her absence, the "ABNORMAL" alarm would be erroneously informed to the administrator, causing him/her to rush to the patient's home. In order to avoid such nonsense, the drug preserver 11 may be provided with a switch which can tell if the patient is at home or not, so that the administrator can obtain more accurate information on the patient before s/he starts an emergency action.

The controller 23 may be adapted to generate an alarm signal when the environmental condition regulator fails to preserve the medicines properly and store relevant information on the malfunction of the regulator.

With this arrangement, accurate information on the conditions of the medicines in the preserver may be obtained, which is helpful in administrating the medicines.

It is noted that adequate preservation of different medicines is possible, since the preserver is partitioned into small preservation rooms that can be used properly for the individual medicines.

It is also noted that the control unit incorporates a communication system and a controller for opening/closing and locking/unlocking the door of the preserver, so that the administration of the preserver by an external facility may be easily established. For example, the dosage of the medicines preserved in the preserver may be properly controlled.

It will be appreciated that each of the partitioned small preservation rooms may be locked independently of the door of the preserver by means of a separate small-door lock system, so that the medicines in the small preservation rooms may be easily administrated independently of the preserver itself.

It will be also appreciated that the sensors for the small preservation rooms enable prevention of wrong dosage (that is, confirmation of proper dosage) by the patient and an estimation of the physical condition of the patient may be easily attained from a remote site.

It will be further appreciated that, since the recording sheets are mounted to be associated with the respective small preservation rooms indicating the items stored therein, and since the recording sheets are lighted in cooperation with the small-door lock system, the location of the relevant preservation rooms and the items therein may be easily confirmed.

What we claim is:

1. A method of operating a drug preserver which includes a multiplicity of small rooms for storing prescribed drugs for a patient, a small rooms lock unit adapted to lock said small rooms, a controller including a memory operative to store a schedule for administering said drugs to said patient and means for generating and selectively routing a signal to said small rooms lock unit to lock or unlock selected ones of said small rooms based on said schedule, means for indicating unlocked ones of said small rooms, and communication means for informing a central monitor station of the operating condition of said drug preserver, comprising the steps of:

said controller generating a signal to said small rooms lock unit for unlocking selected ones of said small rooms according to said schedule stored in said memory, monitoring said drug preserver to determine if said selected small rooms have been opened during a scheduled period for administering the prescribed drugs stored in said small rooms, transmitting a first signal via said communication means to inform said central monitor station of a normal operating condition of said drug preserver when said small rooms have been opened following unlocking as scheduled, transmitting a second signal, alternative to said first signal, via said connection means to inform said central monitor station of an abnormal operating condition of said drug preserver when said small rooms have been unlocked but not opened as scheduled, and providing a switch operable in said connection means by said patient for transmitting to said central monitor station, together with one of said first and second signals, a signal for informing of said patient's presence at, or absence from, said drug preserver.

2. The method of operating a drug preserver according to claim 1, in which said drug preserver includes a releasable door covering each of said small rooms.

3. The method of operating a drug preserver according to claim 1, including the step of indicating a message indicative of the unlocking of said small rooms.

4. The method of operating a drug preserver according to claim 1, in which said drug preserver includes lamps associated with each of said small rooms and said method including the step of illuminating each of said lamps when the small room associated therewith is unlocked.

5. The method of operating a drug preserver according to claim 1, including the step of providing an emergency switch for activating an alarm indicative of an emergency condition of said patient, and for transmitting to said central monitor station an alarm via said communication means.

6. The method of operating a drug preserver according to claim 1, comprising the further steps of:

sensing by an environmental condition sensor at least one of the temperature and the humidity in said drug preserver and emitting a signal in response thereto; and regulating at least one of said temperature and said humidity within respective predetermined ranges based on the signal received from said environmental condition sensor.

7. The method of operating a drug preserver according to claim 6, including the step of:

said environmental condition regulator providing an alarm via said communication means when said regulator has become unable to control said temperature and/or said humidity within said predetermined ranges.

* * * * *